US005515690A

United States Patent [19]

Blackmon et al.

[11] Patent Number: 5,515,690

[45] Date of Patent: May 14, 1996

[54] AUTOMATIC PURGE SUPPLEMENT AFTER CHAMBER WITH ADSORBENT

[75] Inventors: William S. Blackmon; John G. Blackmon, both of Charlotte, N.C.

[73] Assignee: Carolina Products, Inc., Charlotte, N.C.

[21] Appl. No.: 388,219

[22] Filed: Feb. 13, 1995

[51] Int. Cl.[6] ..... F25B 47/00

[52] U.S. Cl. ..... 62/85; 62/195; 62/475; 62/231; 62/158

[58] Field of Search ..... 62/85, 195, 475, 62/157, 158, 231

[56] References Cited

U.S. PATENT DOCUMENTS

| | | | |
|---|---|---|---|
| 3,145,544 | 8/1964 | Weller | 62/195 |
| 3,410,106 | 11/1968 | Brockie | 62/195 |
| 3,664,147 | 5/1972 | Blackmon | 62/85 |
| 3,688,155 | 9/1972 | Lavigne, Jr. | 62/85 |
| 4,169,356 | 10/1979 | Kingham | 62/85 |
| 4,304,102 | 12/1981 | Gray | 62/195 |
| 4,984,431 | 1/1991 | Mount et al. | 62/85 |
| 5,018,361 | 5/1991 | Kroll et al. | 62/85 |
| 5,031,410 | 7/1991 | Plzak et al. | 62/85 |
| 5,187,953 | 2/1993 | Mount | 62/195 |
| 5,261,246 | 11/1993 | Blackmon et al. | 62/85 |
| 5,289,690 | 3/1994 | Rockenfeller et al. | 62/475 |
| 5,303,564 | 4/1994 | Britt | 62/475 |
| 5,313,805 | 5/1994 | Blackmon et al. | 62/195 |
| 5,425,242 | 6/1995 | Dunne et al. | 62/85 |

OTHER PUBLICATIONS

Blue Bottle Helps Save the Ozone Layer, The Spectator, Jul. 14, 1994.

Halozone Purge Capture System Design, Aschematic of the Blue Bottle System.

Environmental System 1000 Refrigerant Loss Monitor, Sen-Tech Corp., Sales Flyer.

*Primary Examiner*—John M. Sollecito

*Attorney, Agent, or Firm*—Louis T. Isaf; James A. Witherspoon

[57] ABSTRACT

A purge supplement includes a vessel that attaches to a gas discharge line of a purge system. Adsorbent material is disposed within the vessel. In a Vent Mode the purge system vents into the vessel and the vessel vents to the atmosphere, whereby the purge system effectively vents through the vessel and the adsorbent material in the vessel adsorbs refrigerant. The purge supplement senses, by employing a weight scale or a refrigerant detection monitor, when the adsorbent material has adsorbed a certain amount of refrigerant, and at that time operation of the purge supplement switches from the Vent Mode to a Recycle Mode. When the transition is made to the Recycle Mode the vessel is isolated from the purge system and, after a slight delay, the atmosphere. After the slight time delay, the vessel is placed in fluid communication with an evaporator of a refrigeration system that the purge supplement is associated with. Refrigerant is drawn out of the adsorbent material and into the evaporator. Then, operation of the purge supplement switches back to the Vent Mode until such time as the purge supplement senses that the adsorbent material has adsorbed the certain amount of refrigerant, at which time operation switches again to the Recycle Mode.

24 Claims, 2 Drawing Sheets

AUTOMATIC PURGE SUPPLEMENT AFTER CHAMBER WITH ADSORBENT

BACKGROUND OF THE INVENTION

The present invention relates to refrigeration systems, and more particularly to an apparatus and method for purging non-condensable gases from a refrigeration system.

In a conventional refrigeration system, particularly in low pressure centrifugal compressor systems, the leakage of air, water vapor, and other contaminating foreign gases into the system is a recognized problem. Such gases reduce the efficiency of the system since they tend to elevate the total pressure in the condenser, and thus more power is required from the compressor per unit of refrigeration. Also, these foreign gases tend to cling to the condenser tubes thereby reducing the total condensing surface area.

To remove these foreign gases from the system, it is common practice to draw a mixture of the gaseous refrigerant and foreign gases from the high pressure region in the condenser or receiver where they normally accumulate, condense the refrigerant and any water vapor by cooling or by compression and cooling, vent off the non-condensables, separate and drain the water, and return the condensed refrigerant to the low pressure region of the system. Typically a purge apparatus is used to remove foreign gases from the refrigeration system in the above manner. A conventional purge apparatus typically comprises a purge chamber wherein the non-condensables gather above the liquid refrigerant and water. A pressure actuated mechanical relief valve automatically opens to vent the non-condensables to the atmosphere through a gas discharge line, and a manual drain is provided to drain off the water which floats on top of the liquid refrigerant. A mechanical valve adjacent the bottom of the purge chamber is opened by a float to drain the condensed refrigerant through a refrigerant line and return it to the low pressure region of the system.

U.S. Pat. No. 3,664,147 to Blackmon discloses an improved purge apparatus that is similar to but improved beyond the type described above. The improved purge apparatus includes an electric float switch in the purge chamber and which is connected to a pair of solenoid actuated valves for (1) discharging a portion of the condensed refrigerant through the refrigerant line to the low pressure region of the refrigeration system when the level of condensed refrigerant rises above a predetermined level, and (2) venting the non-condensable gases to the atmosphere through the gas discharge line when the level of the condensed refrigerant drops below a predetermined level. The apparatus described in the referenced patent has been commercialized in a configuration wherein a compressor is provided in the gas discharge line to facilitate withdrawal of the gas from the purge chamber, which is particularly useful when low operating pressures are utilized in the refrigeration system.

While conventional purge apparatuses such as, but not limited to, those described above are efficient, it is recognized that non-condensed refrigerant remains with the contaminating non-condensable gases in the purge chamber and is vented to the atmosphere through the gas discharge line during the purging operation. Thus, more modern purge apparatuses include many refinements and, as a result, are more efficient (i.e., vent less non-condensed refrigerant to the atmosphere) than the conventional purge apparatuses discussed above. Also, apparatuses that supplement purge apparatus have been developed which also seek to minimize the venting of non-condensed refrigerant from purge apparatuses to the atmosphere.

Examples of more modern purge apparatuses are disclosed in U.S. Pat. Nos. 5,261,246 and 5,313,805, issued to Blackmon et al. These patents disclose the employment of a gas separation tank that is in fluid communication with the gas discharge line. Refrigerant is further separated from non-condensable gases in the gas separation tank. Among many other improvements, these two patents further disclose, in certain embodiments, the placement of refrigerant adsorbing material within the gas separation tank, whereby the adsorbent material adsorbs non-condensed refrigerant passing through the gas discharge line. The adsorbed refrigerant is cyclically withdrawn from the adsorbent material and routed back to the refrigeration system by way of tubing that is part of the purge apparatus. In one configuration the gas separation tank is periodically placed solely in fluid communication with the evaporator such that adsorbed refrigerant is drawn from the adsorbent material to the evaporator. Also, the gas separation tank is heated, which heating tends to drive the adsorbed refrigerant from the adsorbent material. These and other of the more modern purge apparatuses are typically integrated purge apparatuses which are sold as complete units. Accordingly, if it is desirable to decrease the amount of refrigerant that is allowed to vent from a refrigeration system equipped with a less modern purge apparatus, the less modern purge apparatus is often totally replaced with one of the more modern purge apparatuses.

However, it is recognized that even more modern purge apparatuses vent some refrigerant to the atmosphere. It is also recognized that it is sometimes not desirable to completely replace a less modern purge apparatus. Accordingly, a purge supplement apparatus has been developed. The purge supplement apparatus is interposed between the purge apparatus and the atmosphere. That which is vented from the purge apparatus passes through the purge supplement before being released to the atmosphere. The known purge supplement consists of two vessels that are arranged in series and which contain a refrigerant adsorbing material therein. As the purge apparatus vents to the purge supplement, non-condensable gases tend to pass through the purge supplement while refrigerant tends to be adsorbed by the adsorbent material in the purge supplement. It is conventional for the purge supplement to periodically be totally separated from the purge apparatus and be transported to a facility where the adsorbed refrigerant is extracted from the purge supplement. The purge supplement is then reinstalled to the purge apparatus for further use, and the refrigerant extracted from the purge supplement can be manually added to the associated refrigeration system for further use. While the conventional purge supplement seeks to lessen the venting of refrigerant to the atmosphere, it is considered by some to be cumbersome with respect to the that that human labor is required to maintain the operation of the purge supplement.

SUMMARY OF THE INVENTION

Briefly described, the present invention comprises a purge supplement that preferably associates with a purge system that is equipped to a refrigeration system. The purge supplement separates refrigerant from non-condensable gases discharged by the purge system, and the purge supplement fluidly communicates with and returns the separated refrigerant to the refrigeration system.

In accordance with the preferred embodiments of the present invention the purge supplement is readily retrofitable to a wide variety of purge systems. In accordance with alternate embodiments the purge supplement is not retrofitted to, but is integral to, a purge system. In accordance with the preferred embodiments the purge supplement preferably includes a vessel in the form of a canister that attaches to the gas discharge line of a purge system. Adsorbent material is disposed within the canister, and the purge supplement operates in a Vent Mode and a Recycle Mode. In the Vent Mode, the purge system vents into the canister, and the canister vents to the atmosphere (i.e., the purge system vents to the atmosphere by way of the canister). As the purge system vents through the canister, the adsorbent material in the canister adsorbs refrigerant vented from the purge system. The purge supplement senses when the adsorbent material has adsorbed a certain amount of refrigerant, and at that time operation of the purge supplement switches from the Vent Mode to the Recycle Mode. In the Recycle Mode, the canister is isolated from both the purge system and the atmosphere, and the canister is placed in fluid communication with the evaporator of the refrigeration system that the purge supplement is associated with. The evaporator preferably defines a lower pressure than the canister, whereby refrigerant is drawn out of the adsorbent material and into the evaporator. A heater preferably also facilitates the driving of refrigerant from the adsorbent material. Then, operation of the purge supplement switches back to the Vent Mode until such time as the purge supplement senses that the adsorbent material has adsorbed the certain amount of refrigerant, at which time operation switches back to the Recycle Mode.

As mentioned above, the purge supplement senses when the adsorbent material has adsorbed a certain amount of refrigerant, and at that time operation of the purge supplement switches from the Vent Mode to the Recycle Mode. In accordance with the first preferred embodiment of the present invention, the aforementioned sensing is carried out by a weight scale that determines the mass of refrigerant accumulated within the canister. The Recycle Mode is initiated when a first mass of refrigerant is detected by the weight scale. The Vent Mode is subsequently initiated when a certain decrease in mass is detected by the weight scale.

In accordance with the second preferred embodiment of the present invention a refrigerant detection monitor is employed to sense when the adsorbent material has adsorbed a certain amount of refrigerant. In accordance with the second embodiment, while operating in the Vent Mode, as more and more refrigerant is adsorbed by the adsorbent material, the capacity of the adsorbent material for adsorbing refrigerant diminishes. When the refrigerant detection monitor senses that greater concentrations of refrigerant are being vented from the canister, the Recycle Mode is initiated. The Vent Mode is resumed after a time delay.

It is therefore an object of the present invention to further improve the efficiency of purging operations by substantially eliminating the venting of any non-condensed refrigerant to the atmosphere during the purging operation.

Another object of the present invention is to provide a purge supplement which is economical to manufacture and which is effective and efficient in use.

Still another object of the present invention is to provide a purge supplement that operates in an automatic fashion.

Still another object of the present invention is to provide a device that is retrofitable to and increases the efficiency of purge systems.

Still another object of the present invention is to provide an alternative to the total replacement of less modern purge systems.

Still another object of the present invention is to protect the environment by decreasing the amount of environmentally detrimental refrigerant that escapes to the atmosphere.

Other objects, features and advantages of the present invention will become apparent upon reading and understanding this specification, taken in conjunction with the accompanying drawing.

DETAILED DESCRIPTION OF THE PREFERRED EMBODIMENTS

Figure 1:
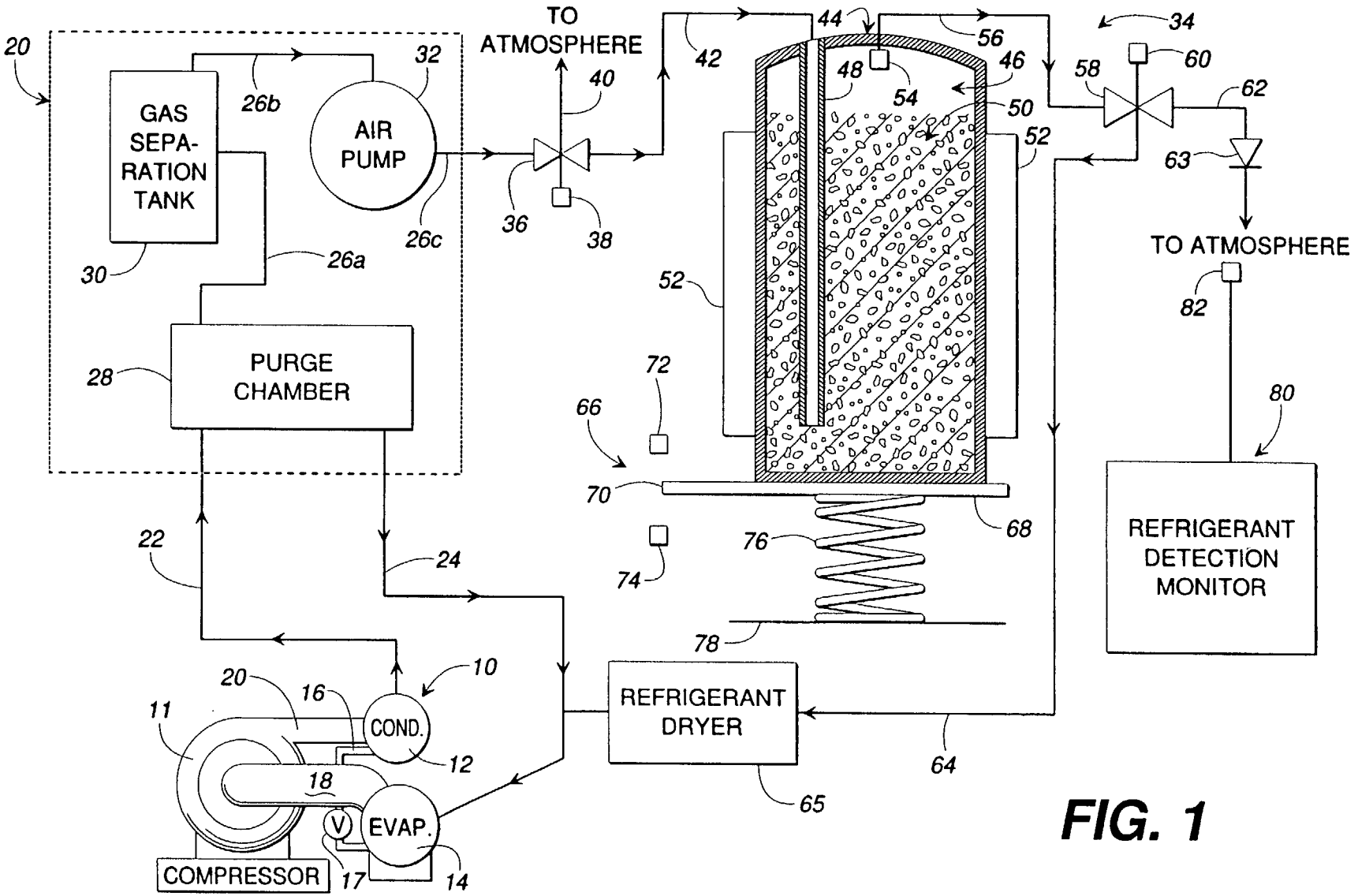
FIG. 1 is a partially cross-sectional, schematic illustration of a conventional refrigeration system incorporating a purge system and a purge supplement, in accordance with preferred embodiments of the present invention.

Referring now in greater detail to the drawing, in which like numerals represent like components throughout the several views, FIG. 1 shows a partially cross-sectional, schematic illustration of a conventional refrigeration system 10 incorporating a purge system 20 and a purge supplement 34, in accordance with preferred embodiments of the present invention. The purge supplement 34 is preferably equipped to a purge system 20 such that a majority of the non-condensable gases extracted from the refrigerant system 10 and subsequently ejected from the purge system 20 pass through the purge supplement 34 prior to being released to the atmosphere. Because the purge supplement 34, which is central to the inventive aspects of the present invention, is downstream of the refrigerant system 10 and the purge system 20, a detailed discussion of the purge supplement 34 will follow an introduction to the refrigeration system 10 and the purge system 20.

The conventional refrigeration system 10 includes a centrifugal compressor 11, a condenser 12, and a cooler or evaporator 14. A line 16 conducts the condensed refrigerant between the condenser 12 and the evaporator 14, and the line 16 includes a conventional restriction or expansion valve 17, which divides the system into a high pressure region in the condenser 12 and a low pressure region in the evaporator 14. A line 18 provides a path of flow for the gaseous refrigerant formed in the evaporator 14 to the compressor 11, where the pressure of the refrigerant is elevated. The pressurized gaseous refrigerant is then discharged through line 20 to the condenser 12 to complete the refrigeration cycle. In accordance with one acceptable embodiment of the present invention, the refrigerant system 10 utilizes a refrigerant such as, but not limited to, R-11 or R1-123 type refrigerant.

Since the low pressure region of the above described refrigeration system 10 is commonly below atmospheric pressure, it is subject to air-in leakage. The water vapor and non-condensable gases which enter with the air collect in the upper portion of the condenser 12 and mix with the gaseous refrigerant. In accordance with the preferred embodiments of the present invention, the purge system 20 is of a type that extracts the water vapor and non-condensable gases from the refrigeration system 10. The purge system 20 preferably includes a mixed gas inlet line 22 through which water vapor, non-condensable gases, and gaseous refrigerant are drawn into the purge system 20 from the condenser 12. The purge system 20 preferably separates a substantial portion of the refrigerant drawn thereinto from the non-condensable gases and water drawn thereinto. That separated refrigerant is discharged back into the refrigeration system 10 by way of a refrigerant line 24 which leads from the purge system 20 to the evaporator 14. The purge system 20 preferably ejects non-condensable gases therefrom by way of a gas discharge line 26*c*.

In accordance with the preferred embodiments of the present invention, the purge supplement 34 is constructed and arranged such that it is capable of being associated with many, if not all, of the known purge systems 20. In accordance with the preferred embodiments of the present invention, the purge supplement 34 is retrofitted to the purge system 20. Alternately, the purge supplement 34 is an integral part of the purge system 20. The purge supplement 34 is acceptably fitted to purge systems 20 such as, but not limited to, those disclosed in U.S. Pat. Nos. 3,664,147, 5,261,246, and 5,313,805 issued to Blackmon and Blackmon et al.; and U.S. Pat. Nos. 3,664,147, 5,261,246, and 5,313,805 are expressly incorporated, in their entirety, herein by reference. For example and not limitation, the purge system 20 disclosed in U.S. Pat. No. 5,261,246 is depicted in FIG. 1 in a schematic and simplified form. Thus, in accordance with the preferred embodiments of the present invention, the purge system 20 acceptably includes a purge chamber 28 to and from which the mixed gas inlet line 22, the refrigerant line 24, and the gas discharge line 26 extend. As depicted in FIG. 1, the gas discharge line 26 includes segments 26*a,b,c*. The purge system 20 acceptably further includes a gas separation tank 30 communicating with the gas discharge line 26*a* downstream of the purge chamber 28, and an air pump 32 communicating with the gas discharge line 26*b* downstream of the gas separation tank.

In accordance with the preferred embodiments of the present invention, the purge supplement 34 is preferably connected to the gas discharge line 26*c*, which is the terminating segment (i.e., farthest downstream segment) of the gas discharge line 26. In accordance with alternate embodiments, the terminating segment of the gas discharge line 26 is the gas discharge line 26*a* or the gas discharge line 26*b*, and in those alternate embodiments the purge supplement 34 is acceptably connected to the gas discharge line 26*a* or the gas discharge line 26*b*.

In accordance with the preferred embodiments of the present invention, the purge supplement 34 includes a three-way valve 36 that is equipped with a solenoid 38. A bypass vent line 40 and an intake line 42 communicate with and extend from the valve 36. The valve 36 is preferably configured such that the gas discharge line 26*c* is normally isolated from the bypass vent line 40 and is normally in fluid communication with the intake line 42. The downstream end of the bypass vent line 40 preferably opens to the atmosphere. The downstream end of the intake line 42 is preferably in fluid communication with the interior of a vessel which is acceptably in the form of a canister 44. The canister 44 is preferably in the general form of a an upright cylindrical tube having closed upper and lower ends. In accordance with one embodiment of the present invention, an acceptable example of the canister 44 is a conventional fifty pound refrigerant recovery cylinder, which recovery cylinder is available where other refrigeration parts and supplies are readily obtained. The canister 44 defines an interior canister chamber 46. The intake line 42 discharges into an internal tube 48 having one end accessible proximate to the top of the canister 44 and an opposite end that is disposed within the canister chamber 46 proximate to the bottom of the canister 44. A portion of adsorbent material 50, which is capable of selectively adsorbing and releasing refrigerant in the manner discussed below, is disposed within the canister chamber 46. For example, in the illustrated embodiment (FIG. 1) the canister chamber 46 is filled to a height of about seven-eighths of the height of the canister 44 with the adsorbent material 50. Acceptable adsorbent materials 50 include, but are not limited to, granulated carbon.

In accordance with the preferred embodiments of the present invention, the purge supplement 34 is equipped with a heater 52 that functions to periodically heat the adsorbent material 50, as discussed in greater detail below. The heater 52 acceptably includes an electric heating element that jackets the canister 44. The canister 44 preferably defines a vent port 54 from which an exhaust line 56 extends and by virtue of which the exhaust line 56 is in fluid communication with the canister chamber 46. The downstream end of the exhaust line 56 fluidly communicates with a three-way valve 58 that is equipped with a solenoid 60. A vent line 62 and a recycle line 64 communicate with and extend from the valve 58. The valve 58 is preferably configured such that the exhaust line 56 is normally isolated from the recycle line 64 and is normally in fluid communication with the vent line 62. That is, the valve 58 is normally configured such that it closes the end of the recycle line 64 that is distant from the evaporator 14. The downstream end of the vent line 62 preferably opens to the atmosphere, and a check valve 63 is preferably disposed within the vent line 62. The downstream end of the recycle line 64 is preferably in fluid communication with the evaporator 14, and the recycle line 64 preferably communicates with a refrigerant dryer 65. In accordance with one embodiment of the present invention, an acceptable example of the refrigerant dryer 65 is a forty cubic inch, SPORLAN brand refrigerant dryer, which dryer is available where other refrigeration pans and supplies are readily obtained.

In accordance with the first preferred embodiment of the present invention the purge supplement 34 further includes a switch actuating weight scale 66 which functions to signal for/control the operation of the valves 36,58, as discussed below. An acceptable example of the weight scale 66 is depicted in FIG. 1. The weight scale 66 is depicted as including a platform 68 upon which the canister 44 is situated. The platform 68 includes a switch finger 70 protruding therefrom which periodically contacts an upper switch 72 and a lower switch 74, as discussed in greater detail below. A coil spring 76 suspends the platform 68, and thereby the canister 44, above a reference point 78.

In accordance with the second preferred embodiment of the present invention, the purge supplement 34 does not employ the weight scale 66, but rather employs a switch actuating refrigerant detection monitor 80. The monitor functions in place of the weight scale 66 to signal/control the operation of the valves 36,58. The monitor 80 preferably samples the materials being discharged from the downstream end of the vent line 62 by way of a sampler device 82. The monitor 80 acceptably utilizes a sensor such as, but not limited to, an ionization type sensor to detect refrigerant being discharged from the vent line 62. An acceptable example of the monitor 80 is an Environmental System 1000 Refrigerant Loss Monitor, Model 1030, available from Sen-Tech Corporation of Indianapolis, Ind.

In operation, the purge supplement 34 functions, in accordance with the preferred embodiments, to receive gases discharged from the gas discharge line 26 of the purge system 20. In the depicted embodiment the purge supplement 34 receives gases discharged from the gas discharging line 26*c*. The purge supplement 34 acts upon the received gases to (i) separate refrigerant from contaminating gases and route that refrigerant back to the refrigeration system 10, and (ii) vent the contaminating gases to the atmosphere. In accordance with the preferred embodiments of the present invention, the purge supplement 34 generally functions in two modes; a Vent Mode and a Recycle Mode.

In accordance with the preferred embodiments of the present invention, the Vent Mode occurs when the valve 36 is configured in its normal or deenergized configuration (during which the gas discharge line 26*c* is isolated from the bypass vent line 40 and in fluid communication with the intake line 42, as discussed above) and the valve 58 is configured in its normal or deenergized configuration (during which the exhaust line 56 is isolated from the recycle line 64 and in fluid communication with the vent line 62, as discussed above). In accordance with the preferred embodiments, when in the Vent Mode, a differential pressure exists between the downstream terminus of the gas discharge line 26*c* and the downstream terminus of the vent line 62 by virtue of the operational characteristics of the purge system 20. Hence, during the Vent Mode non-condensable gases discharged from the purge system 20 pass into the upper end of the internal tube 48 and are expelled from the lower end of the internal tube 48, whereby the gases flow upward through the adsorbent material 50. The adsorbent material 50 preferably functions to adsorb a substantial portion of the refrigerant entrained in the non-condensable gases and allow the non-condensable gases to flow out of the canister 44 and vent to the atmosphere by way of the vent line 62. It is preferable for the refrigeration system 10 and the purge system 20 to be operating in a manner such that the purge system 20 is only periodically required to discharge gases into the purge supplement 34. However, the purge supplement 34 is preferably capable of functioning and reducing the amount of refrigerant discharged to the atmosphere even when the refrigeration system 10 and purge system 20 are operating in a manner which results in the frequent or constant discharging of gases from the purge system 20.

While the purge supplement 34 discharges into and through the canister 44 during the Vent Mode, the amount of refrigerant that is adsorbed/accumulated by the adsorbent material 50 increases. In accordance with the preferred embodiment of the present invention, once a certain amount of refrigerant has been adsorbed/accumulated by the adsorbent material 50, the purge supplement 34 preferably automatically reconfigures to operate in the Recycle Mode. The predetermined amount is preferably less than an amount that would substantially diminish the capacity of the adsorbent material 50 for separating refrigerant from non-condensable gases, whereby the predetermined amount is less than an amount that would saturate the adsorbent material. When the purge supplement 34 reconfigures to operate in the Recycle Mode, the valve 36 is energized (whereby the gas discharge line 26*c* is in fluid communication with the bypass vent line 40 and is isolated from the intake line 42) and the valve 58 is, after a time delay, energized (whereby the exhaust line 56 is in fluid communication with the recycle line 64 and is isolated from the vent line 62). Thus, in the Recycle Mode the canister chamber 46 is isolated from the purge system 20; and after a time delay the canister chamber 46 is isolated from atmosphere and placed in fluid communication with the evaporator 14.

In accordance with the preferred embodiments of the present invention, the evaporator 14 defines a pressure therein that is less than the pressure that is defined within the canister chamber 46 during the Vent Mode, whereby during the Recycle Mode the relatively low pressure of evaporator 14 functions to draw refrigerant out of the adsorbent material 50 and back into the refrigeration system 10. In accordance with the preferred embodiments of the present invention, the evaporator 14 defines a pressure that is below atmospheric pressure and is approximately fourteen to sixteen inches of mercury, and that pressure of the evaporator 14 functions to very effectively draw refrigerant out of the adsorbent material 50. Thus, it is preferable not to employ a vacuum pump or the like in the recycle line 64. In accordance with the preferred embodiments of the present invention the drawing of refrigerant out of the adsorbent material 50 and back into the refrigerant system 10 is enhanced by the heater 52 which functions to heat the adsorbent material 50 during the Recycle Mode. It is realized that some moisture might tend to pass through the purge supplement 34 and be drawn back into the evaporator 14 by way of the recycle line 64. However, the refrigerant dryer 65 seeks to remove any such moisture from refrigerant passing through the recycle line 64.

In accordance with the preferred embodiments of the present invention, after refrigerant is drawn from the adsorbent material 50 to the evaporator 14, the purge supplement 34 preferably automatically reconfigures to operate in the Vent Mode. In accordance with the preferred embodiments, at the instant that the transition is made to the Vent Mode, the canister chamber 46 is below atmospheric pressure by virtue of the fact that the evaporator 14 is preferably operating at below atmospheric pressure and was in communication the canister chamber 46 during the Recycle Mode. Accordingly, the check valve 63 in the vent line 62 seeks to preclude any back-flow from the atmosphere into the canister chamber 46.

Figure 2:
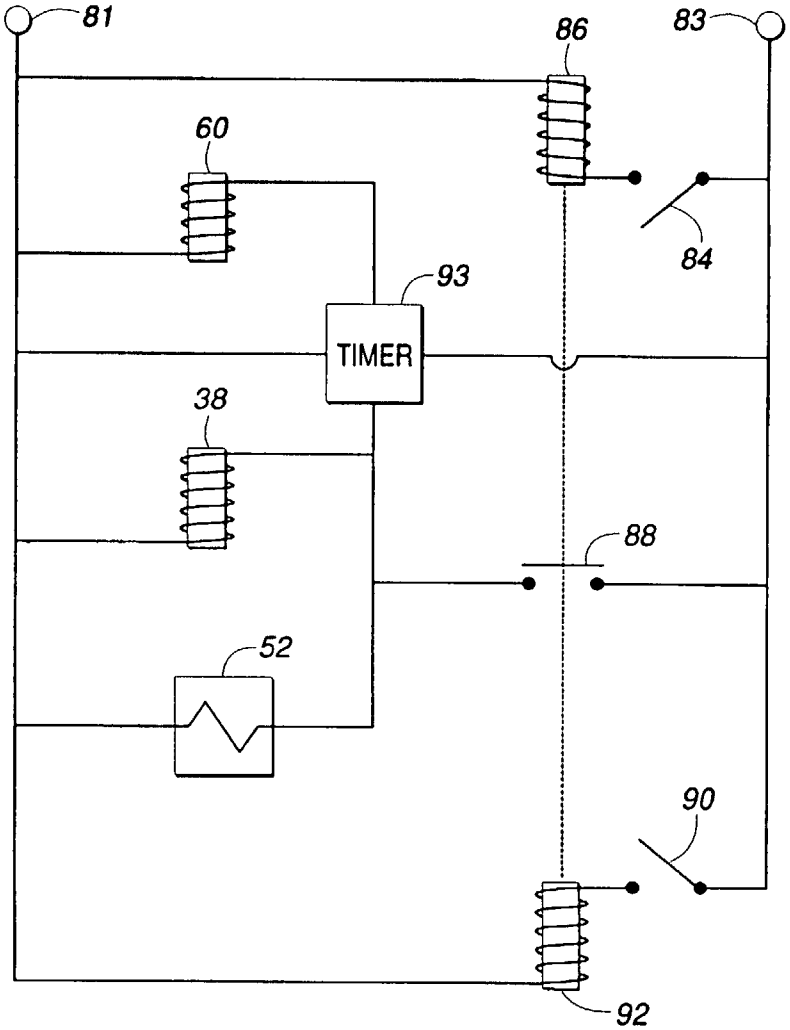
FIG. 2 is a schematic wiring diagram of the purge supplement, in accordance with a first preferred embodiment of the present invention.

FIG. 2 is an acceptable example of a schematic wiring diagram of the purge supplement 34 (FIG. 1), in accordance with the first preferred embodiment of the present invention. In accordance with the first preferred embodiment of the present invention A voltage potential is established between power leads 81, 83, and electrical components 38, 52, 60, 84, 86, 88, 90, 92, 93 are wired therebetween, as discussed in greater detail below. The upper switch 72 (FIG. 1) includes a switch contact 84 that is biased toward an open configuration. The switch contact 84 actuates a relay 86 that is operatively connected to a relay contact 88. The lower switch 74 includes a switch contact 90 that is also biased toward an open configuration. The switch contact 90 actuates a relay 92 that is also operatively connected to the relay contact 88. In accordance with the first preferred embodiment of the present invention, the purge supplement 34 further includes a timer assembly 93. In accordance with one embodiment of the present invention, acceptable examples of the timer assemblies 93, 98 are a Q1T-00600-341 and a Q4T-03600-341, respectively; both of which are available from National Controls Corporation of West Chicago, Ill. In accordance with the preferred embodiments of the present invention, the electronic components of the purge supplement 34 operate, at least to a limited degree, separately from the electronic components of the purge system 20.

In FIG. 2, the electronic components of the purge supplement 34 (FIG. 1) are depicted as though the purge supplement 34 is operating in the Vent Mode. During the Vent Mode, the relay contact 88 is open such that the solenoid 38 (which operates the valve 36 (FIG. 1)) and heater 52 (see also FIG. 1) are not energized. Further, when the relay contact 88 is open the tinier assembly 93 is not triggered, whereby the solenoid 60 (which operates the valve 58 (FIG. 1)) is not energized. Thus, when relay contact 88 is open, the valves 36, 58 are in their normal/deenergized (i.e., Vent Mode) configurations, as discussed above.

Referring additionally to FIG. 1, while the purge supplement 34 operates in the Vent Mode, the adsorbent material 50 adsorbs an increasing amount of refrigerant such that the spring 76 compresses and the switch finger 70 contacts the lower switch 74 when a certain mass of refrigerant has accumulated within the canister 44. As an example, the purge supplement 34 might acceptably be constructed and arranged such that the accumulation of five pounds of refrigerant within the canister 44 will cause the spring 76 to compress such that the switch finger 70 contacts the lower switch 74. The contacting of the switch finger 70 upon the lower switch 74 affects the closure of the switch contact 90, which energizes relay 92, which closes relay contact 88. Closure of the relay contact 88 affects the transition to the Recycle Mode. More particularly, closure of the relay contact 88 energizes the heater 52 such that it heats the adsorbent material 50, and energizes the solenoid 38 such that the valve 36 achieves its energized (i.e., Recycle Mode) configuration, as discussed above.

It is recognized that, at the instant when the transition is made from the Vent Mode to the Recycle Mode, it is likely that some non-condensable gases will be within the canister chamber 46. In accordance with the preferred embodiments of the present invention this is accounted for by delaying the operation of the valve 58 when the transition is made from the Vent Mode to the Recycle Mode. More particularly, in accordance with the first preferred embodiment of the present invention, closure of the relay contact 88 additionally triggers the timer assembly 93. In accordance with the first and second preferred embodiments of the present invention, the triggering of the timer assembly 93 causes the timer assembly 93 to energize the solenoid 60 after a slight delay. The energizing of the solenoid 60 causes the valve 58 to achieve its energized (i.e., Recycle Mode) configuration as discussed above.

The delayed operation of the valve 58, which is caused by the timer assembly 93 when the transition is made between the Vent Mode and the Recycle Mode, seeks to allow the venting of non-condensable gases from the canister 44 prior to the initiation of fluid communication between the canister 44 and the evaporator 14. It is thought that some of the non-condensable gas within the canister 44 will be vented during the time delay by virtue of the fact that the non-condensable gases are typically lighter than refrigerant, whereby the non-condensable gases will tend to accumulate above the refrigerant in the canister 44, whereby the expansion of the refrigerant that is caused by the heater 52 will tend to push the non-condensable gas out of the canister 44. It is thought that a time delay of approximately two minutes might be found to be acceptable. In accordance with certain embodiments, time delays of more or less than two minutes might acceptably be employed. In accordance with certain alternate embodiments, the timer assembly 93 is not employed, whereby the valve 58 actuates generally in unison with the valve 36.

In accordance with the first preferred embodiment of the present invention, as refrigerant is drawn out of the adsorbent material 50 during the Recycle Mode, the mass of refrigerant within the canister 44 decreases such that the spring 76 eventually pushes the switch finger 70 into contact with the upper switch 72. Contact between the switch finger 70 and the upper switch 72 preferably occurs when approximately one pound of refrigerant remains in the canister 44. In accordance with alternate embodiments, amounts greater than or less than one pound of refrigerant result in contact between the switch finger 70 and the upper switch 72. Contact of the switch 72 affects closure of the switch contact 84, which affects energizing of the relay 86, which affects opening of the relay contact 88. Opening of the relay 88 deenergizes the heater 52 and the solenoid 38, whereby the valve 36 returns to its normal/deenergized (i.e., Vent Mode) configuration, as discussed above. Opening of the relay 88 also terminates the triggering of the timer assembly 93, whereby that the solenoid 60 is no longer energized such that the valve 58 returns to its normal/deenergized (i.e., Vent Mode) configuration, as discussed above. The valves 36, 58 preferably operate in unison when returning to their vent mode configurations. The weight scale 66 is preferably capable of being adjusted to vary the triggering of the switch contacts 84, 90.

Figure 3:
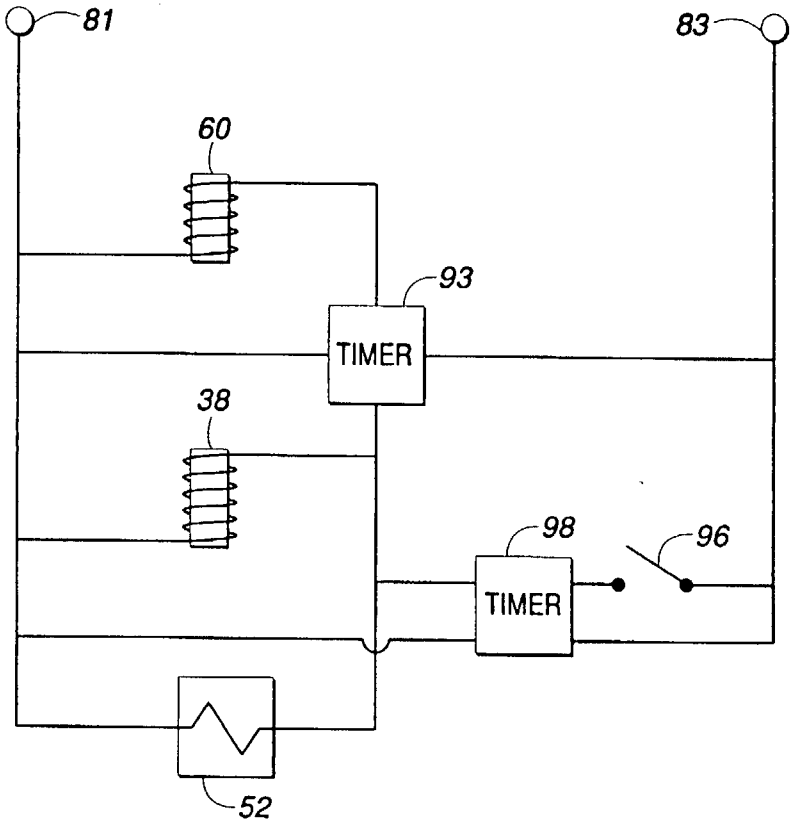
FIG. 3 is a schematic wiring diagram of the purge supplement, in accordance with a second preferred embodiment of the present invention.

FIG. 3 is an acceptable example of schematic wiring diagram of the purge supplement 34 (FIG. 1), in accordance with the second preferred embodiment of the present invention. As mentioned previously, in accordance with the second preferred embodiment the purge supplement 34 does not include the switch actuating weight scale 66 (FIG. 1), whereby the electrical components associated therewith are not depicted in FIG. 2. In accordance with the second preferred embodiment, the refrigerant detection monitor 80 (FIG. 1) preferably functions in place of the switch actuating weight scale 66. The refrigerant detection monitor 80 preferably includes a contact 96 that is normally open. In accordance with the second preferred embodiment the purge supplement 34 further includes a second timer assembly 98.

With additional reference to FIG. 1, and in accordance with the second preferred embodiment of the present invention, while the purge supplement 34 is operating in the Vent Mode and the adsorbent material 50 adsorbs refrigerant, the capacity of the adsorbent material 50 for adsorbing refrigerant decreases, whereby more refrigerant is vented from the canister 44 by way of the vent line 62. The refrigerant detection monitor 80 senses the increased venting of the refrigerant, and in response to the increased venting of refrigerant the refrigerant detection monitor 80 closes the contact 96. The refrigerant detection monitor 80 is preferably capable of being adjusted to vary the triggering of the contact 96. The refrigerant detection monitor 80 might acceptably be set to trigger the contact 96 when the concentration of the refrigerant discharging from the vent line 62 is approximately ten parts per million. In accordance with that embodiment In accordance with the second preferred embodiment, closure of the contact 96 triggers the timer assembly 98. Once the contact 96 is triggered, the timer assembly 98 preferably immediately triggers the timer assembly 93 and energizes the solenoid 38 and the heater 52. In accordance with the second preferred embodiment, once the timer assembly 93 is triggered and the solenoid 38 and heater 52 are energized, they and the components associated therewith function as described above with respect to the first preferred embodiment, whereby the purge supplement 34 operates in the Recycle Mode. The timer assembly 98 functions to maintain, for a certain period of time, the triggering of the timer assembly 93 and the energizing of the solenoid 38 and the heater 53. After a certain period of time, such as but not limited to ten minutes, has elapsed, the timer assembly 93 is untriggered and the solenoid 38 and heater 52 are deenergized, whereby the components associated therewith function as described above with respect to the first preferred embodiment so that the purge supplement 34 operates in the Vent Mode.

In accordance with a first alternate embodiment of the present invention, the purge supplement 34 (FIG. 1) does not include the upper switch 72 (FIG. 1) or the refrigerant detection monitor 80, and the electronics of the first alternate embodiment are acceptably as depicted in FIG. 3. In accordance with the first alternate embodiment, actuation of the lower switch 74 afflicts the momentary closure of the contact 96, and from an electronic standpoint the purge supplement 34 of the first alternate embodiment operates as described above with respect to the second preferred embodiment.

It should be understood that the present invention is not to be limited by the fact that the valves 36, 58 (FIG. 1) are three-way valves. In accordance with alternate embodiments of the present invention, each three-way valve 36, 58 is, for example and not limitation, replaced with a pair of valves and some associated tubing modifications. In accordance with another alternate embodiment, the attachment of a second purge supplement 34 (FIG. 1) at the downstream end of the bypass vent line 40 and the attachment of a third purge supplement 34 at the downstream end of the vent line 62 is contemplated such that purge supplements 34 are employed in parallel/series.

It should also be understood that the scope of the present invention is not to be limited by the particular electronic configurations/logic depicted in FIGS. 2 and 3. In accordance with the preferred embodiments of the present invention a programmable logic controller (PLC), the type and operation of which is considered readily understood and practicable by one skilled in the art once the operational sequences described above are understood, is employed to control/facilitate the operation of the purge supplement 34. In accordance with certain embodiments of the present invention, the programmable logic controller is preferably further employed to accumulate operational data and control alarms associated with the purge supplement 34.

While certain of the preferred and alternate embodiments of the present invention have been disclosed herein, other embodiments of the apparatus and methods of the present invention will suggest themselves to persons skilled in the art in view of this disclosure. Therefore, it will be understood that variations and modifications can be effected within the spirit and scope of the invention and that the scope of the present invention should only be limited by the claims below. Additionally, while it is intended that the scope of the present invention also include various alternate embodiments, it should be understood that each of the embodiments disclosed herein, including the preferred embodiments, include features and characteristics which are considered independently inventive. Accordingly, the disclosure of variations and alterations expressed in alternate embodiments is intended only to reflect on the breadth of the scope of the present invention without suggesting that any of the specific features and characteristics of the preferred embodiment are in any way obvious or unimportant.

I claim:

1. A purge supplement apparatus for use with a purge system that is equipped to a refrigeration system; wherein the refrigeration system includes a condenser, an evaporator, and a compressor communicating between the condenser and the evaporator; and wherein the purge system includes a purge chamber into which refrigerant and non-condensable gases are drawn from the refrigeration system and are separated, a refrigerant line directing refrigerant from the purge chamber back to the refrigeration system, and a gas discharge line directing non-condensable gases away from the purge system; the purge supplement apparatus comprising:

a vessel defining a vessel chamber selectively communicating with the gas discharge line;

adsorbent material disposed within said vessel chamber, wherein non-condensable gases and refrigerant directed from the purge chamber through the gas discharge line are exposed to said adsorbent material and said adsorbent material adsorbs the refrigerant;

a control means for generating a signal when a certain amount of refrigerant has been adsorbed by said adsorbent material;

a recycle means for, in response to said signal, establishing fluid communication between said vessel chamber and the refrigeration system, and drawing refrigerant from said adsorbent material and routing the drawn refrigerant to the refrigeration system; and an inlet means for isolating said vessel chamber from the gas discharge line when fluid communication is established between said vessel chamber and the refrigeration system.

2. The purge supplement apparatus of claim 1, wherein said control means includes a weight scale for generating said signal when a predetermined mass of refrigerant is disposed within said vessel chamber.

3. The purge supplement apparatus of claim 2, wherein said recycle means includes a recycle line extending from said vessel chamber to the evaporator, and a first valve means for, in response to said signal, placing said vessel chamber in fluid communication with the evaporator through said recycle line so that refrigerant is passed from said adsorbent material to the evaporator, and wherein said inlet means includes a second valve means for isolating said vessel chamber from said gas discharge line when said vessel chamber is in fluid communication with the evaporator through said recycle line.

4. The purge supplement apparatus of claim 3, further comprising a heater for heating said adsorbent material.

5. The purge supplement apparatus of claim 3, further comprising a venting means for venting non-condensable gases from said vessel chamber.

6. The purge supplement apparatus of claim 1, wherein the purge supplement apparatus further comprises a vent means for venting non-condensable gases from said vessel chamber, and wherein said control means includes a refrigerant detector for generating said signal when a certain concentration of refrigerant is vented by said vent means with the non-condensable gases.

7. The apparatus of claim 6, wherein said recycle means includes a recycle line extending from said vessel chamber to the evaporator, and a first valve means for, in response to said signal, placing said vessel chamber in fluid communication with the evaporator through said recycle line so that refrigerant is passed from said adsorbent material to the evaporator, and wherein said inlet means includes a second valve means for isolating said vessel chamber from said gas discharge line when said vessel chamber is in fluid communication with the evaporator through said recycle line.

8. The purge supplement apparatus of claim 7, wherein said venting means also includes said first valve means.

9. The purge supplement apparatus of claim 7, wherein said detection means includes a refrigerant monitor.

10. The purge supplement apparatus of claim 7, further comprising a heater for heating said adsorbent material.

11. A method of purging non-condensable gases from a refrigeration system which comprises a compressor, a condenser, and an evaporator, wherein a first line supplies gaseous refrigerant and non-condensable gases from the condenser to a purge chamber, and a second line supplies condensed refrigerant from the purge chamber to the evaporator, the method comprising the following steps:

providing a vessel, wherein the vessel defines a vessel chamber;

providing an adsorbent material within the vessel chamber;

discharging non-condensable gases and refrigerant from the purge chamber into the vessel chamber so that refrigerant is adsorbed by the adsorbent material;

venting non-condensable gases from the vessel chamber;

determining when a certain amount of refrigerant is disposed within the vessel chamber; and drawing refrigerant from the adsorbent material in response to a determination that the certain amount or refrigerant is disposed within the vessel chamber, wherein the step of drawing refrigerant includes steps of providing a third line between the vessel chamber and the refrigeration system, and periodically passing refrigerant through the third line from the vessel chamber to the refrigeration system.

12. The method of claim 11, wherein the certain amount of refrigerant is less than the amount of refrigerant required to saturate the adsorbent material.

13. The method of claim 11, wherein the venting step and the drawing step do not occur at the same time.

14. The method of claim 11, wherein the method further comprises steps of terminating discharging step in response to a determination that the certain amount of refrigerant is disposed within the vessel chamber, counting through a time period in response to the terminating step, ceasing the venting step in response to the passage of the time period of the counting step, and wherein the drawing step is initiated in response to the passage of the time period of the counting step.

15. The method of claim 11, wherein the third line extends between the vessel chamber and the evaporator.

16. The method of claim 11, wherein the determining step includes a step of weighing the vessel to determine when a certain mass of refrigerant is disposed within the vessel chamber, and wherein the periodically drawing step occurs in response to a determination that the certain mass of refrigerant is disposed within the vessel chamber.

17. The method of claim 11, wherein the determining step includes a step of monitoring the non-condensable gases vented from the vessel chamber during the venting step to determine when a certain concentration of refrigerant is being vented from the vessel chamber, and wherein the periodically drawing step occurs in response to a determination that the certain concentration of refrigerant is being vented from the vessel chamber.

18. A method of purging non-condensable gases from a refrigeration system which comprises a compressor, a condenser, and an evaporator, wherein a first line supplies gaseous refrigerant and non-condensable gases from the condenser to a purge chamber, and a second line supplies condensed refrigerant from the purge chamber to the evaporator, the method comprising the following steps:

providing a vessel, wherein the vessel defines a vessel chamber;

establishing fluid communication between the purge chamber and the vessel chamber such that non-condensable gases and refrigerant flow from the purge chamber into the vessel chamber;

venting non-condensable gases from the vessel chamber;

terminating the fluid communication between the purge chamber and the vessel chamber;

counting through a time period in response to the step of terminating the fluid communication between the purge chamber and the vessel;

terminating the venting step in response to passage of the time period of the counting step; and establishing, in response to the passage of the time period of the counting step, fluid communication between the vessel chamber and the refrigeration system such that refrigerant flows from the vessel chamber to the refrigeration system.

19. The method of claim 18, wherein the step of counting through a time period comprises allowing at least half a minute to pass.

20. The method of claim 18, wherein the venting step includes a step of venting from a position proximate to the top of the vessel chamber, and wherein the method further comprises a step of heating the vessel, whereby refrigerant within the vessel tends to expand such that non-condensable gasses within the vessel chamber tend to vent from the vessel chamber during the counting step.

21. The method of claim 18, wherein the method further comprising steps of providing an adsorbent material within the vessel chamber, allowing the adsorbent material to adsorb and accumulate refrigerant flowing from the purge chamber into the vessel chamber, determining when a certain amount of refrigerant is accumulated within the vessel chamber, and wherein the step of terminating the fluid communication between the purge chamber and the vessel occurs in response to a determination that the certain amount of refigerant is accumulated within the vessel chamber.

22. The method of claim 21, wherein the certain amount of refrigerant is less than the amount of refrigerant required to totally saturate the adsorbent material.

23. The method of claim 21, wherein the determining step includes a step of weighing the vessel to determine when a certain mass of refrigerant is disposed within the vessel chamber, and wherein the step of terminating the fluid communication between the purge chamber and the vessel chamber occurs in response to a determination that the certain mass of refrigerant is disposed within the vessel chamber.

24. The method of claim 21, wherein the determining step includes a step of monitoring the non-condensable condensable gases vented from the vessel chamber during the venting step to determine when a certain concentration of refrigerant is being vented from the vessel chamber, and wherein the step of terminating the fluid communication between the purge chamber and the vessel chamber occurs in response to a determination that the certain concentration of refrigerant is being vented from the vessel chamber.

* * * * *